US010941470B2

(12) United States Patent
Chen et al.

(10) Patent No.: US 10,941,470 B2
(45) Date of Patent: Mar. 9, 2021

(54) CR-MN-N AUSTENITIC HEAT-RESISTANT STEEL AND A METHOD FOR MANUFACTURING THE SAME

(71) Applicant: Tianjin New Wei San Industrial Co., Ltd., Tianjin (CN)

(72) Inventors: Yousan Chen, Tianjin (CN); Changbin Chen, Tianjin (CN); Zhengde Lin, Tianjin (CN); Zhixiong Guo, Tianjin (CN); Michel Millot, Tianjin (CN); Chengxing Xie, Tianjin (CN); Jinhui Wang, Tianjin (CN); Xuewen Wen, Tianjin (CN); Mingming Tan, Tianjin (CN); Lintao Zong, Tianjin (CN); Henglin Tian, Tianjin (CN)

(73) Assignee: TIANJIN NEW WEI SAN INDUSTRIAL CO., LTD., Tianjin (CN)

( * ) Notice: Subject to any disclaimer, the term of this patent is extended or adjusted under 35 U.S.C. 154(b) by 249 days.

(21) Appl. No.: 15/687,071

(22) Filed: Aug. 25, 2017

(65) Prior Publication Data

US 2018/0057918 A1 Mar. 1, 2018

(30) Foreign Application Priority Data

Aug. 26, 2016 (CN) ..... 201610740208.6

(51) Int. Cl.

| | |
|---|---|
| ***C22C 38/58*** | (2006.01) |
| ***C21C 7/00*** | (2006.01) |
| ***C22C 38/40*** | (2006.01) |
| ***B22D 43/00*** | (2006.01) |
| ***C22C 38/00*** | (2006.01) |
| ***C22C 38/02*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/58* (2013.01); *B22D 43/005* (2013.01); *C21C 7/0075* (2013.01); *C21C 7/0087* (2013.01); *C22C 38/001* (2013.01); *C22C 38/002* (2013.01); *C22C 38/005* (2013.01); *C22C 38/02* (2013.01); *C22C 38/40* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search

CPC ..... C22C 38/40; C22C 38/14; C22C 38/30; C22C 38/58; C22C 38/001; C22C 38/002; C22C 38/005; C22C 38/02; C22C 38/44; C22C 38/46; C22C 38/48; C22C 38/50; C22C 38/52; C22C 38/54; C21C 7/0075; C21C 7/0087; B22D 43/005

See application file for complete search history.

(56) References Cited

U.S. PATENT DOCUMENTS

| | | | | |
|---|---|---|---|---|
| 5,019,332 | A * | 5/1991 | Wegman | C22C 38/58 420/47 |
| 10,316,694 | B2 * | 6/2019 | Chintalapati | F01D 5/28 |
| 2009/0160217 | A1 * | 6/2009 | Kimura | C21D 6/005 296/187.03 |
| 2016/0032433 | A1 * | 2/2016 | Chintalapati | C22C 38/48 420/59 |
| 2018/0298462 | A1 * | 10/2018 | Sano | C22C 38/00 |

FOREIGN PATENT DOCUMENTS

| | | | |
|---|---|---|---|
| CA | 103898397 | A | 7/2014 |
| CN | 85102472 | A | 8/1986 |
| CN | 103898398 | A | 7/2014 |
| CN | 105002431 | A | 10/2015 |

* cited by examiner

*Primary Examiner* — Alexandra M Moore
*Assistant Examiner* — Adil A. Siddiqui
(74) *Attorney, Agent, or Firm* — Birch, Stewart, Kolasch & Birch, LLP

(57) ABSTRACT

A Cr—Mn—N austenitic heat-resistant steel is provided. The heat-resistant steel comprises, in weight percentage, carbon 0.20% to 0.50%, silicon 0.50% to 2.00%, manganese 2.00% to 5.00%, phosphorus less than 0.04%, sulphur less than 0.03%, chromium 20.00% to 27.00%, nickel 6.00% to 8.00%, molybdenum less than 0.50%, niobium less than 0.60%, tungsten less than 0.60%, vanadium less than 0.15%, nitrogen 0.30% to 0.60%, zirconium less than 0.10%, cobalt less than 0.10%, yttrium less than 0.10%, boron less than 0.20%, with the balance iron. The heat-resistant steel has high temperature strength, high thermal conductivity, low thermal expansion coefficient, good dimensional stability, good ductility, heat resistance, impact resistance, and low production costs, and meets the requirements for high performance engines.

12 Claims, No Drawings

CR-MN-N AUSTENITIC HEAT-RESISTANT STEEL AND A METHOD FOR MANUFACTURING THE SAME

TECHNICAL FIELD

This invention relates to the field of steel for automobiles, and in particular to a Cr—Mn—N austenitic heat-resistant steel and a method for manufacturing the same.

BACKGROUND

With higher function and lightness of automobiles, temperature of the automotive exhaust is increased due to an increase of the engine speed, and the highest working temperature of the exhaust manifold and the turbocharger, connected to the engine, can rise to 1050° C. or ever higher. Accordingly, this requires materials used for the turbine housing and the exhaust manifold not only to have sufficient strength at high temperatures and heat resistance but also good dimensional stability and high ductility as well as good heat conduction capability during its long-time service at elevated temperature.

Currently, the materials of the turbocharger housing and the exhaust manifold are primarily hi-sil-moly ductile iron and Ni-resist ductile iron (see CN 103898398A and CN 103898397A). The highest working temperature of the materials is lower than 1000° C., and can not work normally at higher temperatures. Further, when working at temperatures higher than 1000° C., the materials have problems such as a low thermal conductivity, a strength reduction at high temperatures and a high thermal expansion coefficient associated with oxidation and thermal fatigue limit. In addition, the materials also have a disadvantage of high cost due to the addition of a large amount of nickel element. Therefore, these materials can not meet the requirements for high performance engines.

SUMMARY

In view of this, an objective of the present invention is to provide a Cr—Mn—N austenitic heat-resistant steel with a high strength at high temperatures, a high thermal conductivity and a low thermal expansion coefficient, as well as characteristics of high metallographic structure stability, good dimensional stability, high ductility, heat resistance, impact resistance, and low manufacturing cost, thereby to meet the requirements for high performance engines.

To achieve the above objective, the present invention provides the following technical schemes.

The present invention provides a Cr—Mn—N austenitic heat-resistant steel, comprising, in weight percentage: carbon 0.20% to 0.50%, silicon 0.50% to 2.00%, manganese 2.00% to 5.00%, phosphorus less than 0.04%, sulphur less than 0.03%, chromium 20.00% to 27.00%, nickel 6.00% to 8.00%, molybdenum less than 0.50%, niobium less than 0.60%, tungsten less than 0.60%, vanadium less than 0.15%, nitrogen 0.30% to 0.60%, zirconium less than 0.10%, cobalt less than 0.10%, yttrium less than 0.10%, boron less than 0.20%, with the balance iron.

Preferably, the Cr—Mn—N austenitic heat-resistant steel comprises, in weight percentage, carbon 0.30% to 0.45%, silicon 0.80% to 1.50%, manganese 3.00% to 4.80%, phosphorus less than 0.02%, sulphur less than 0.02%, chromium 23.00% to 26.00%, nickel 6.50% to 7.00%, molybdenum less than 0.20%, niobium less than 0.30%, tungsten less than 0.40%, vanadium less than 0.12%, nitrogen 0.40% to 0.50%, zirconium less than 0.08%, cobalt less than 0.08%, yttrium less than 0.08%, boron less than 0.10%, with the balance iron.

In the present invention, both the manganese and nitrogen elements can facilitate the austenite formation, and the nitrogen element has 30 times greater ability to facilitate the austenite formation than the nickel element. The nickel element is replaced with the manganese and nitrogen elements to facilitate the austenite formation. The cost of the manganese and nitrogen elements is only 20% to 30% of the cost of the nickel element. So, the austenitic heat-resistant steel can be produced with lower production cost. In addition, the nitrogen element also has capabilities for stabilizing microstructure at elevated temperatures, enhancing strength at elevated temperatures, improving pitting resistance and resisting stress corrosion cracking. The manganese element can act as a good desulfurizing agent and a good deoxidizer, and thus make contents of the sulphur and oxygen contained in the liquid steel held at a lower level, enhance the instantaneous strength at elevated temperatures, and improve creep rupture strength and creep performance of the material. The Cr—Mn—N austenitic heat-resistant steel provided by the present invention has characteristics of high temperature strength, high thermal conductivity, excellent fatigue performance at high temperatures, lower thermal expansion coefficient, higher metallographic structure stability, good dimensional stability, higher ductility, heat resistance, impact resistance, low production costs, etc., thereby to meet the requirements for high performance engines. So, the steel of the present invention can be widely used as the material of the automobile turbine housing and the exhaust manifold.

The present invention further provides a method for manufacturing the Cr—Mn—N austenitic heat-resistant steel in the above technical schemes, comprising the following steps:

(a) forming a melt by smelting raw alloy materials of the elements; and (b) after being left to stand, the melt formed in step (a) is cast for molding to obtain the Cr—Mn—N austenitic heat-resistant steel.

preferably, a temperature for the smelting in said step (a) is 1580 to 1700° C.

preferably, a time for the melt being left to stand in said step (b) is 3 to 20 minutes.

preferably, after the melt being left to stand in said step (b), a slag removing process is further performed.

preferably, a temperature for the Cr—Mn—N austenitic heat-resistant steel being cast-molded is 1550 to 1650° C.

The method for manufacturing the Cr—Mn—N austenitic heat-resistant steel provided by the present invention is simple. The Cr—Mn—N austenitic heat-resistant steel manufactured by this method has characteristics of high temperature strength, high thermal conductivity, excellent fatigue performance at high temperatures, lower thermal expansion coefficient, higher metallographic structure stability, good dimensional stability, higher ductility, heat resistance, impact resistance, low production costs, etc., thereby to meet the requirements for high performance engines.

DETAILED DESCRIPTION

The present invention provides a Cr—Mn—N austenitic heat-resistant steel, comprising, in weight percentage, carbon 0.20% to 0.50%, silicon 0.50% to 2.00%, manganese 2.00% to 5.00%, phosphorus less than 0.04%, sulphur less than 0.03%, chromium 20.00% to 27.00%, nickel 6.00% to 8.00%, molybdenum less than 0.50%, niobium less than 0.60%, tungsten less than 0.60%, vanadium less than 0.15%, nitrogen 0.30% to 0.60%, zirconium less than 0.10%, cobalt less than 0.10%, yttrium less than 0.10%, boron less than 0.20%, with the balance iron.

In the present invention, the Cr—Mn—N austenitic heat-resistant steel preferably comprises, in weight percentage, carbon 0.30% to 0.45%, silicon 0.80% to 1.50%, manganese 3.00% to 4.80%, phosphorus less than 0.02%, sulphur less than 0.02%, chromium 23.00% to 26.00%, nickel 6.50% to 7.00%, molybdenum less than 0.20%, niobium less than 0.30%, tungsten less than 0.40%, vanadium less than 0.12%, nitrogen 0.40% to 0.50%, zirconium less than 0.08%, cobalt less than 0.08%, yttrium less than 0.08%, boron less than 0.10%, with the balance iron.

In the present invention, both the manganese and nitrogen elements can facilitate the austenite formation, and the nitrogen element has 30 times greater ability to facilitate the austenite formation than the nickel element. The cost of the manganese and nitrogen elements is only 20% to 30% of the cost of the nickel element. So, the austenitic heat-resistant steel can be produced with lower production cost. In addition, the nitrogen element also has capabilities for stabilizing microstructure, enhancing strength at elevated temperatures, improving pitting resistance and resisting stress corrosion cracking. The manganese element can act as a good desulfurizing agent and a good deoxidizer, and thus make contents of the sulphur and oxygen contained in the liquid steel held at a lower level, enhance the instantaneous strength at elevated temperatures, and improve creep rupture strength and creep performance of the steel. The Cr—Mn—N austenitic heat-resistant steel provided by the present invention has characteristics of high temperature strength, high thermal conductivity, excellent fatigue performance at high temperatures, lower thermal expansion coefficient, higher metallographic structure stability, good dimensional stability, higher ductility, heat resistance, impact resistance, low production costs, etc., thereby to meet the requirements for high performance engines. So, the steel of the present invention can be widely used as the material of the automobile turbine housing and the exhaust manifold.

The present invention further provides a method for manufacturing the Cr—Mn—N austenitic heat-resistant steel. The method comprises the following steps:

(a) forming a melt by smelting raw alloy materials of the elements; and (b) After being left to stand, the melt formed in step (a) is cast for molding to obtain the Cr—Mn—N austenitic heat-resistant steel.

In the present invention, the source of the raw alloy materials of the elements is not particularly limited, any commodities on the market of the raw alloy materials well known to those skilled in the art may be available. In the embodiments of the present invention, raw alloy materials of the elements are preferably silicon-iron, manganese, ultra-low carbon ferrochrome, ferroniobium, ferrotungsten, ferrovanadium, nickel plate, nitrided ferrochrome alloy, zirconium metal, yttrium metal, cobalt metal and ferroboron.

In the present invention, the temperature for the smelting in step (a) is preferably 1580 to 1700° C., more preferably 1600 to 1680° C., and most preferably 1630 to 1650° C.

In the present invention, the time for the smelting in step (a) is preferably 0.5 to 3.0 h, more preferably 0.6 to 2.0 h, and most preferably 0.8 to 1.5 h.

In the present invention, the heating modes for smelting the raw alloy materials are not particularly limited, any heating mode well known to those skilled in the art may be available. The devices for smelting the raw alloy materials are not particularly limited, any smelting device well known to those skilled in the art can be available. In the embodiments of the present invention, the smelting process is preferably carried out in a medium-frequency induction furnace.

After obtainment of the melt, the melt is left to stand for some minutes, and then cast for molding to obtain the Cr—Mn—N austenitic heat-resistant steel. A standing time is preferably 3 to 20 minutes, more preferably 5 to 15 minutes, and most preferably 8 to 12 minutes.

After the standing, preferably, a slag removing process is performed for the melt to remove the slag on the surface of the melt. The slag removing process is not particularly limited, any process for removing the slag well known to those skilled in the art can be available. In the present invention, a mechanical slag removing process is preferred.

According to the present invention, the melt, after being left to stand, is cast for molding. A preferred temperature for the Cr—Mn—N austenitic heat-resistant steel being cast-molded is 1550 to 1650° C., more preferably 1560 to 1630° C., and most preferably 1580 to 1620° C.

In the present invention, the device for the melt being cast for molding after being left to stand is not particularly limited, any device well known to those skilled in the art is available. In the embodiments of the present invention, the process of the melt being cast for molding is preferably performed in a casting ladle.

In the present invention, after the melt being cast for molding, processes of sand blasting, grinding, trimming and inspection are preferably performed. The processes of sand blasting, grinding, trimming and inspection are not particularly limited, any process well known to those skilled in the art may be available.

The method for manufacturing the Cr—Mn—N austenitic heat-resistant steel provided by the present invention is simple. The Cr—Mn—N austenitic heat-resistant steel manufactured by this method has characteristics of high temperature strength, high thermal conductivity, excellent fatigue performance at high temperatures, oxidation resistance at high temperatures, lower thermal expansion coefficient, higher metallographic structure stability, good dimensional stability, higher ductility, heat resistance, impact resistance, low production costs, etc., thereby to meet the requirements for high performance engines.

The Cr—Mn—N austenitic heat-resistant steel and the method for manufacturing the same of this invention will be described in details hereinafter in combination with examples, but these examples should not be construed as limiting the scope of the invention.

Example 1

I. Ingredients: main raw materials in weight percentage: carburant 0.32%, steel scrap 43.39%, chromium nitride 8.58%, ultra-low carbon ferrochrome 34.31%, electrolytic manganese 5.15%, ferrosilicon 1.25%, and nickel plate 7.0%.

II. Smelting: a medium-frequency induction furnace was used for smelting. The capacity of the induction furnace may range from 0.5 tons to 3 tons. The weighed raw materials were fed sequentially into the medium-frequency induction furnace, which was then energized and heated up. After the materials were completely melted, the temperature inside the medium-frequency induction furnace was raised to 1580° C. A spectroscopic analysis was performed for the melt inside the medium-frequency induction furnace by using a test strip for spectroscopic analysis. The analysis result was shown in the following table.

| | Element | | | | | | | | |
|---|---|---|---|---|---|---|---|---|---|
| | C | Si | Mn | P | S | Cr | Ni | Mo | Nb |
| wt (%) | 0.43 | 1.20 | 4.72 | 0.010 | 0.008 | 25.64 | 6.72 | 0.013 | 0.0076 |

| | Element | | | | | | | |
|---|---|---|---|---|---|---|---|---|
| | W | V | N | Zr | Y | B | Co | Fe |
| wt (%) | 0.0141 | 0.1084 | 0.4967 | 0.052 | 0.061 | 0.002 | 0.07 | 60.4472 |

III. Tapping and melt processing: after the chemical composition of the melt met the requirements, liquid steel inside the furnace was heated to 1630° C. and then tapped. Before the tapping, the furnace was powered off for a rest time of 8 minutes, and then slag on the surface of the liquid steel was removed. A casting ladle preheated sufficiently was positioned at a liquid steel outlet of the induction furnace, waiting for tapping the liquid steel. After completion of the tapping, the slag on the surface of the liquid steel was removed, and casting was expected.

IV. Casting and box detaching: when a casting temperature reached 1550° C., a casting process was performed. After 40 minutes from completion of the casting, a box detaching process was performed.

V. Post processing: after the box detaching process, processes of sand blasting, grinding, trimming, inspection, etc., were performed so that a Cr—Mn—N austenitic heat-resistant steel was obtained.

The Cr—Mn—N austenitic heat-resistant steel produced in Example 1 was tested, and results were as followings: the tensile strength at 1050° C. was 78 MPa or higher, the yield strength was 75 MPa or higher, the thermal conductivity was 28.1 $W/(m^2 \cdot K)$ or more, the modulus of elasticity was 105 GPa or more, and the thermal expansion coefficient at 1100° C. was 20.0 $(1/K \cdot 10^{-6})$; the Cr—Mn—N austenitic heat-resistant steel had properties such as excellent high temperature strength, a high thermal conductivity and a fast thermodiffusion speed; and Ni was replaced with Mn and N, thereby greatly decreasing the production costs.

Example 2

I. Ingredients: main raw materials in weight percentage: carburant 0.35%, steel scrap 43.29%, chromium nitride 8.65%, ultra-low carbon ferrochrome 33.71%, electrolytic manganese 5.35%, ferrosilicon 1.55%, and nickel plate 7.1%.

II. Smelting: a medium-frequency induction furnace was used for smelting. The capacity of the induction furnace may range from 0.5 tons to 3 tons. The weighed raw materials were fed sequentially into the medium-frequency induction furnace, which was then energized and heated up. After the materials were completely melted, the temperature inside the medium-frequency induction furnace was raised to about 1600° C. A spectroscopic analysis was performed for the melt inside the medium-frequency induction furnace by using a test strip for spectroscopic analysis. The analysis result was shown in the following table.

| | Element | | | | | | | | |
|---|---|---|---|---|---|---|---|---|---|
| | C | Si | Mn | P | S | Cr | Ni | Mo | Nb |
| wt (%) | 0.50 | 1.23 | 4.76 | 0.020 | 0.010 | 25.40 | 6.79 | 0.034 | 0.0015 |

| | Element | | | | | | | |
|---|---|---|---|---|---|---|---|---|
| | W | V | N | Zr | Y | B | Co | Fe |
| wt (%) | 0.0079 | 0.0966 | 0.4395 | 0.043 | 0.055 | 0.0018 | 0.09 | 60.5207 |

III. Tapping and melt processing: after the chemical composition of the melt met requirements, liquid steel inside the furnace was heated to 1680° C. and then tapped. Before the tapping, and the furnace was powered off for a rest time of 3 minutes, and then slag on the surface of the liquid steel was removed. A casting ladle preheated sufficiently was positioned at a liquid steel outlet of the induction furnace, waiting for tapping the liquid steel. After completion of the tapping, the slag on the surface of the liquid steel was removed, and casting was expected.

IV. Casting and box detaching: when a casting temperature reached 1650° C., a casting process was performed. After 60 minutes from completion of the casting, a box detaching process was performed.

V. Post processing: after the box detaching process, processes of sand blasting, grinding, trimming, inspection, etc., were performed so that a Cr—Mn—N austenitic heat-resistant steel was obtained.

Comparative Example

Same raw materials were used and weighed according to their respective amounts. A comparison between a Cr—Ni austenitic heat-resistant steel designated GX40CrNiSiNb25-20 according to European standard EN 10295 and the Cr—Mn—N austenitic heat-resistant steel produced in Example 2 was made. An analysis result of the composition of the former was listed in the following table.

Analysis Result of the Composition of the Cr—Ni Austenitic Heat-Resistant Steel Designated GX40CrNiSiNb25-20

| | Element | | | | | | | | |
|---|---|---|---|---|---|---|---|---|---|
| | C | Si | Mn | P | S | Cr | Ni | Mo | Nb |
| wt (%) | 0.40 | 1.24 | 1.06 | 0.020 | 0.010 | 24.85 | 19.54 | 0.03 | 1.42 |

| | Element | | | | | | | |
|---|---|---|---|---|---|---|---|---|
| | W | V | N | Zr | Y | B | Co | Fe |
| wt (%) | — | 0.089 | — | — | — | — | — | 51.341 |

It can be seen from a comparison between the compositions of the above two materials that the major differences are the amounts of Mn, Ni, Nb and N elements. A cost comparison between the above two materials based on 1000 kg liquid steel was listed in the following table (number 1 represents the Cr—Mn—N austenitic heat-resistant steel produced in Example 2, and number 2 represents the heat-resistant steel designated GX40CrNiSiNb25-20).

| | Raw Material | Mn | ultra-low carbon Fe—Cr | Ni Plate | Fe—Nb | CrN | Steel scrap | Total (RMB) |
|---|---|---|---|---|---|---|---|---|
| | Price (RMB/kg) | 11.1 | 12.55 | 70.3 | 175.5 | 17.4 | 1.8 | |
| | Yield % | 100% | 60% | 100% | 60% | 8.5% | 100% | |
| No. 1 | Added amount (Kg) | 50 | 367 | 70 | — | 56 | 457 | |
| | Cost of raw material added | 555 | 4606 | 4921 | — | 974 | 823 | 11879 |
| No. 2 | Added amount | 13 | 417 | 200 | 24 | — | 346 | |
| | Cost of raw material added | 144 | 5233 | 14060 | 4212 | — | 623 | 24272 |

PS: The alloy cost of Zr, Y, Co and B added for the No. 1 material was 580 RMB in total.

From the viewpoint of cost, the cost for the Cr—Mn—N austenitic heat-resistant steel was only 51% of that for the heat-resistant steel designated GX40CrNiSiNb25-20.

As compared to the Comparative Example, the Cr—Mn—N austenitic heat-resistant steel of the present invention exhibited an increase of 219 MPa in the yield strength at room temperature, an increase of 379 MPa in the tensile strength, an increase of 7.8% in the modulus of elasticity at room temperature, an increase of 30.4% in the thermal conductivity at room temperature, and an increase of 14.4% in the thermal conductivity at 1100° C. Specific test results were listed in Table 1.

TABLE 1

Comparison of test results between the Example 2 and the Comparative Example

| | Properties | | | | | | | |
|---|---|---|---|---|---|---|---|---|
| | $R_{p0.2}$ (MPa) | | $R_m$ (MPa) | | E (GPa) | | λ/W/(m · K) − 1 | |
| Number | RT | 1100 ? | RT | 1100 ? | RT | 1100 ? | 50 ? | 1100 ? |
| 1 | 523 | 58 | 850 | 59 | 193 | 105 | 13.3 | 30.9 |
| 2 | 304 | 46 | 471 | 50 | 179 | 104 | 10.2 | 27.0 |

It can be seen from the above property comparison that the property of the Cr—Mn—N austenitic heat-resistant steel of the present invention was superior to the Comparative Example, and the production costs were greatly decreased.

The descriptions above are just preferred embodiments of the present invention. It should be noted that for those skilled in the art, improvements and embellishements may be made without departing from the principle of the present invention, and shall also be considered within the scope of the present invention.

What is claimed is:

1. A Cr—Mn—N austenitic heat-resistant steel, comprising, in weight percentage:

carbon 0.20% to 0.50%, silicon 0.50% to 2.00%, manganese 2.00% to 5.00%, phosphorus less than 0.04%, sulphur less than 0.03%, chromium 20.00% to 27.00%, nickel 6.72% to 8.00%, molybdenum 0.013% to 0.50%, niobium 0.0015% to 0.60%, tungsten 0.0079% to 0.60%, vanadium 0.0966% to 0.15%, nitrogen 0.30% to 0.60%, zirconium 0.043% to 0.10%, cobalt 0.07% to 0.10%, yttrium 0.055% to 0.10%, boron less than 0.20%, with the balance iron.

2. The Cr—Mn—N austenitic heat-resistant steel of claim 1, comprising, in weight percentage:

carbon 0.30% to 0.45%, silicon 0.80% to 1.50%, manganese 3.00% to 4.80%, phosphorus less than 0.02%, sulphur less than 0.02%, chromium 23.00% to 26.00%, nickel 6.72% to 7.00%, molybdenum 0.013% to 0.20%, niobium 0.0015% to 0.30%, tungsten 0.0079% to 0.40%, vanadium 0.0966% to 0.12%, nitrogen 0.40% to 0.50%, zirconium 0.043% to 0.08%, cobalt 0.07% to 0.08%, yttrium 0.055% to 0.08%, boron less than 0.10%, with the balance iron.

3. A method for manufacturing the Cr—Mn—N austenitic heat-resistant steel of claim 1, comprising the following steps:

(a) forming a melt by smelting raw alloy materials of the elements; and (b) after being left to stand, the melt formed in step (a) is cast for molding to obtain the Cr—Mn—N austenitic heat-resistant steel.

4. The method of claim 3, wherein, a temperature for the smelting in said step (a) is 1580 to 1700° C.

5. The method of claim 3, wherein, a time for the melt being left to stand in said step (b) is 3 to 20 minutes.

6. The method of claim 5, wherein, after the melt being left to stand in said step (b), a slag removing process is further performed.

7. The method of claim 3, wherein, a temperature for the Cr—Mn—N austenitic heat-resistant steel being cast-molded is 1550 to 1650° C.

8. A method for manufacturing the Cr—Mn—N austenitic heat-resistant steel of claim 2, comprising the following steps:

(a) forming a melt by smelting raw alloy materials of the elements; and (b) after being left to stand, the melt formed in step (a) is cast for molding to obtain the Cr—Mn—N austenitic heat-resistant steel.

9. The method of claim 8, wherein, a temperature for the smelting in said step (a) is 1580 to 1700° C.

10. The method of claim 8, wherein, a time for the melt being left to stand in said step (b) is 3 to 20 minutes.

11. The method of claim 10, wherein, after the melt being left to stand in said step (b), a slag removing process is further performed.

12. The method of claim 8, wherein, a temperature for the Cr—Mn—N austenitic heat-resistant steel being cast-molded is 1550 to 1650° C.

* * * * *